United States Patent [19]

Everroad

[11] 4,079,933

[45] Mar. 21, 1978

[54] EXERCISE DEVICE FOR USE IN THE PERFORMANCE OF SIT-UPS

[76] Inventor: James M. Everroad, 3044 Thirtieth St., Columbus, Ind. 47201

[21] Appl. No.: 738,010

[22] Filed: Nov. 2, 1976

[51] Int. Cl.[2] ..... A63B 21/00

[52] U.S. Cl. ..... 272/121; 272/126

[58] Field of Search ..... 272/116, 137, 121, 109, 272/119, 120, 126; 128/134; 182/3, 4, 5

[56] References Cited

U.S. PATENT DOCUMENTS

| | | | |
|---|---|---|---|
| 2,716,027 | 8/1955 | Gehri | 272/121 |
| 2,877,833 | 3/1959 | Boles | 182/3 X |
| 3,937,461 | 2/1976 | Lew | 272/109 |

FOREIGN PATENT DOCUMENTS

| | | | |
|---|---|---|---|
| 1,519,711 | 2/1968 | France | 272/121 |
| 279,927 | 4/1952 | Switzerland | 272/120 |
| 22,932 of | 1901 | United Kingdom | 272/121 |

*Primary Examiner*—Richard C. Pinkham
*Assistant Examiner*—William R. Browne
*Attorney, Agent, or Firm*—Woodard, Weikart, Emhardt & Naughton

[57] ABSTRACT

An exercise device comprising a shoulder harness which is connected through a line extending over a pulley to individual handle members. The pulley is secured to a fixed support and the person using the device is positioned on the floor near and facing the support. The exercise device is used to assist in the performance of sit-ups from a variety of initial positions. As force is applied through the handles to move them away from the pulley, this force is transmitted through the connecting line to the shoulder harness to urge it toward the pulley.

2 Claims, 4 Drawing Figures

EXERCISE DEVICE FOR USE IN THE PERFORMANCE OF SIT-UPS

BACKGROUND OF THE INVENTION

1. Field of the Invention

This invention relates to an exercise device for assisting a person to perform a large number of repetitions of the customary sit-up exercise.

2. Description of the Prior Art

It has long been known that periodic exercising contributes to a person's physical appearance and fitness. Exercises are generally designed to develop strength and/or reduce the amount of fat in a particular region of the body. In order to remove or reduce the amount of fat in a given area, it is generally necessary to perform numerous repetitions of an exercise directed at using the muscles of that area. Jogging, for example, reduces the amount of fat on a person's legs by employing the leg muscles over and over during the exercise. Similarly, it is generally recognized that the customary sit-up is an exercise which is directed at the abdominal region and brings the abdominal muscles into play as the exercise is performed. The sit-up, whether with the legs straight or bent at the knees, is a relatively strenuous exercise in that it is difficult to continuously repeat the exercise for a substantial amount of time. As a result, it has generally been difficult to employ the sit-up exercise to reduce the amount of fat and build up the muscle tone of the abdominal or stomach region, without a long and strenous conditioning program.

In order to facilitate the performance of exercises such as the sit-up, various mechanical devices have been devised. The advantage of employing such a device is that the sit-up, for example, may be repeated more times than would otherwise be possible. Because the exercise may be repeated a greater number of times, the effect of the fat reduction and muscle conditioning is enhanced. Many of the prior art devices are rather bulky and expensive, however, and therefore are not appropriate for the individual home user. These devices are generally available, as a practical matter, only through a health spa or similar establishment. The need has therefore arisen for an exercise device which is simple and inexpensive, while also being reliable and effective.

A particular exercise device of the prior art is disclosed in U.S. Pat. No. 3,858,874, issued to Weider on Jan. 7, 1975. The Weider device consists of a pair of pulleys which are secured through a connecting member to a door knob or other fixed support. A flexible line extends over each of the pulleys. Each line includes an end which has a loop to be grasped by one hand of the user of the device. The other end of each line consists of a pair of loops which are to be fitted about an ankle and instep of the user. The Weider device is used by the person lying on the floor in a direction facing away from the support upon which the pulley is secured. Movement of the user's hand away from the associated pulley provides a force which urges the respective leg toward the pulley. The Weider device is therefore useful in assisting a person to perform leg lifting exercises of different types.

SUMMARY OF THE INVENTION

An exercise device is disclosed herein which comprises a harness adapted to be received about the shoulders of a person, handle means for providing a location to be grasped by a person, flexible line means for connecting the harness to the handle means, the line means including a flexible line connected at one end to the harness and at the other end to the handle means, and pulley means for moveably supporting the line means, the pulley means being adapted to be secured to a fixed support, whereby force applied to move the handle means away from the pulley means is transmitted through the line means to move the harness toward the pulley means.

It is an object of the present invention to provide an exercise device which is simple, inexpensive and lightweight, and which is of a durable construction.

It is another object of the present invention to provide an exercise device which is useful in assisting a person in performing a number of repetitions of the sit-up exercise.

It is a further object of the present invention to provide an exercise device as described above which assists the user in reducing the amount of fat in the abdominal region and in increasing the muscle tone of that region.

Another object of the present invention is to provide an exercise device which is portable and which may be used in any place where there is a fixed support to which it may be attached.

A further object of the present invention is to provide an exercise device, as described, which in use contributes to the loosening and flexibility of the back muscles.

Further objects and advantages of the present invention will become apparent from the description which follows.

DESCRIPTION OF THE PREFERRED EMBODIMENT

Figure 1:
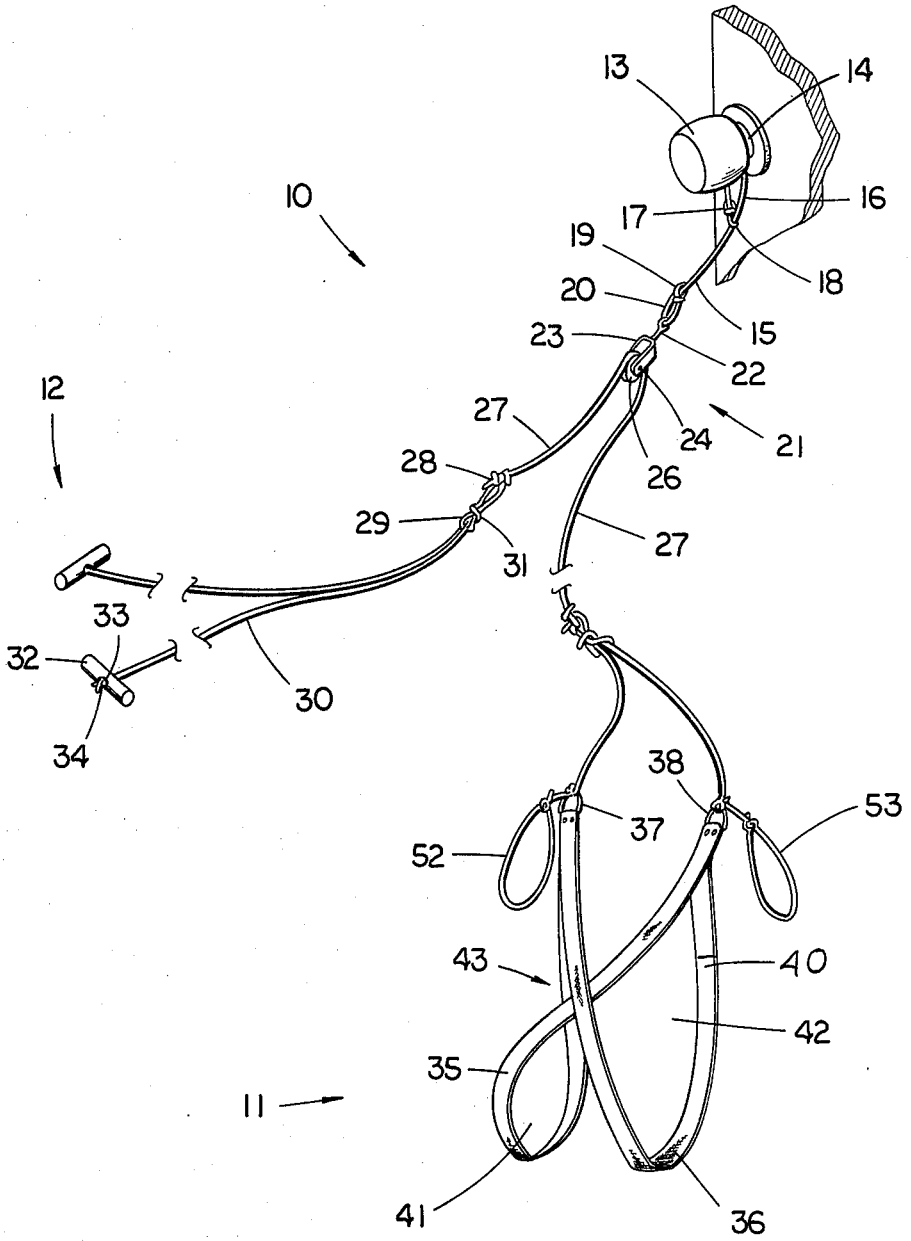
FIG. 1 is a perspective view of the exercise device of the present invention, shown attached to a door knob.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
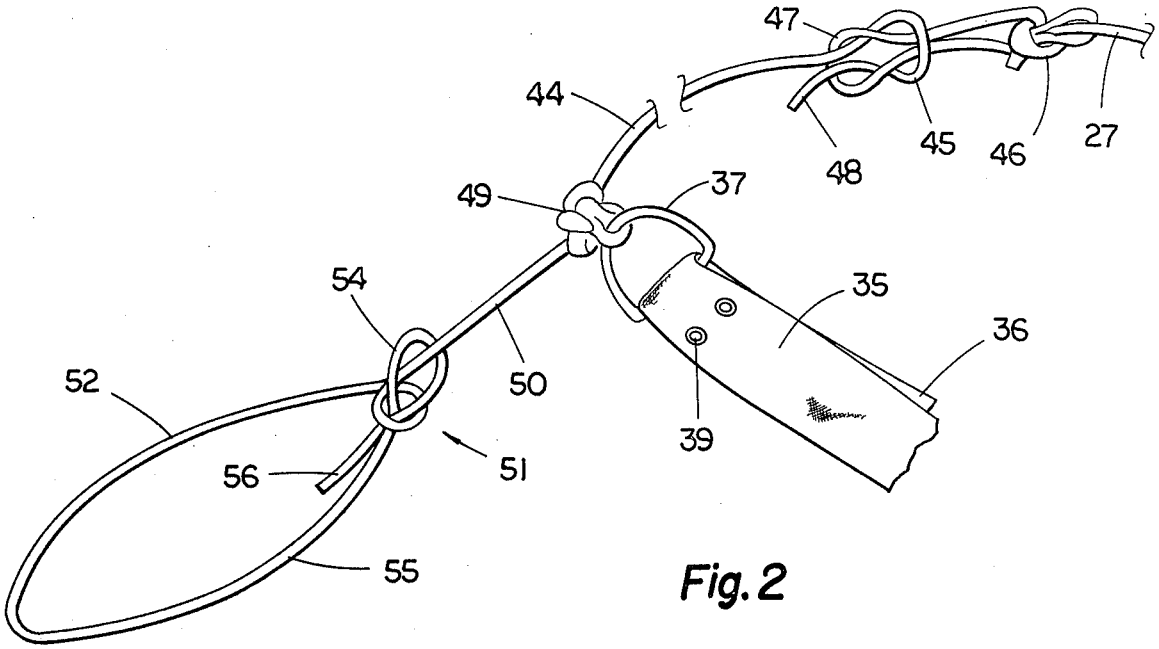
FIG. 2 is a perspective view of a portion of the exercise device of the present invention, particularly showing one of the arm loop members.

Referring in particular to FIGS. 1 and 2, there is shown the exercise device 10 of the present invention. As will be more fully described below, exercise device 10 enables the user to perform numerous repetitions of the sit-up exercise to thereby reduce the amount of fat in the abdominal region and generally improve the physical conditioning of that area of the body. Device 10 includes a shoulder harness 11 connected through line 27 to the handles 12. Line 27 extends about wheel 26 of pulley 21 and is thereby moveably supported. Pulley 21 is connected through attachment member 15 to the shaft 14 of door knob 13.

A number of the connecting elements in the preferred embodiment of the present invention comprise flexible, line members. For the purposes of this specification and the claims, a flexible line is intended to mean any cord-like member which would have the appropriate flexibility and strength to permit the device to be used for the exercises for which it is designed. The flexible lines may, for example, be ropes or cords of nylon or other materials. The lines could also less preferably comprise an integral, plastic or other body of appropriate shape. Nylon roping is preferred since it provides the requisite flexibility while also being both strong and durable.

Handles 12 comprise a line 30 having handle grips 32 connected at each end. Grips 32 define apertures 33 through which the respective portions of line 30 are threaded. The ends of line 30 are then formed into knots 34 to engage grips 32. Line 30 is connected to line 27 which includes a loop portion 29 defined by the end portion of line 27 being folded over on itself and knotted at 28. Loop portion 29 is engaged by loop portion 31 of line 30 to provide the interconnection of lines 27 and 30. By this form of interconnection, handles 12 are securely connected to line 27, and yet it is possible to separate the two if required. The separation may be accomplished by moving an additional portion of line 30 through loop 29 until the loop portion 31 is of sufficient size to pass the remaining portion of device 10 therethrough.

Harness 11 comprises a pair of straps 35 and 36 which are preferably formed from a flexible, cloth-like material. One end of each of the straps is secured to D-ring 37, and the other ends are attached to D-ring 38. Preferably, the straps 35 and 36 form a portion of a continuous strap which is connected at its ends 40 to form a continuous loop. The ends of straps 35 and 36 at D-rings 37 and 38 are then integral with each other. Securement of the strap ends to the respective D-rings is accomplished by rivets 39 which secure straps 35 and 36 together and cause the straight portion of the respective D-ring to be enclosed thereby. Straps 35 and 36 may then be crossed, such as at 43, to define shoulder openings 41 and 42. The harness 11 is then put on by the user by inserting his head through the space between D-rings 37 and 38, and inserting an arm through each of the shoulder openings 41 and 42. Straps 35 and 36 will then cross somewhere along the user's back, and the straps could be secured at this location 43, although it is not preferred.

D-rings 37 and 38 are connected through line 44 to the end of line 27. Line 27 includes a loop 47 defined by the end portion of line 27 being folded over upon itself and knotted at 46. Line 44 includes a portion 45 which engages loop 47 and securely holds it thereto.

As is particularly shown in FIG. 2, line 44 preferably also forms the arm loops which form a part of the shoulder harness 11. A knot 49 is used to secure line 44 to D-ring 37. A bowline knot 51 is then formed in line 44 to provide the arm loop 52. Line 44 includes a linear portion 50 which extends from arm loop 52 to the point of attachment of line 44 to D-ring 37. The bowline knot 51 is employed as a means for permitting the size of arm loop 52 to be adjusted, this type of knot being known to be useful for this particular purpose. Arm loop 52 thus includes a fixed end 54 and a portion 55 which is moveable with respect to knot 51. Thus, end 56 may be threaded through the loop formed by portion 54, permitting portion 55 to be further extended from knot 51. Arm loop 52 thus includes a circumferential measurement which may be adjusted by manipulation of end 56 and portion 55. Similarly, suitable manipulation of knot 51 can lead to the adjustment of the length of linear portion 50. It is to be understood that various other means may be employed to permit the adjustment of the length of portion 50 and the circumference of loop 52, as is known in the art. Portion 48 (FIG. 2) of line 44 extends to the other D-ring 38 and a similar arm loop 53 is there located.

Harness 11 is connected through line 27 to handles 12. Line 27 extends about wheel 26 of pulley 21. Wheel 26 is rotatably received upon pivot pin 24 which is secured at its ends 25 to frame 23. An eyelet 22 is attached to frame 23. Line 15 includes a loop portion 20 defined by the line being knotted at 19, the loop 20 engaging eyelet 22 to form a connection therebetween. Line 15 further includes a portion 16 which is positioned about a fixed support such as shaft 14 of door knob 13. The end of line 15 includes a loop 18 defined by the line being knotted at 17. Portion 16 is received within loop 18 and thereby forms a slip knot which provides a means for readily attaching line 15 to a fixed support.

The exercise device 10 of the present invention permits the user to perform numerous repetitions of the sit-up exercise to reduce the amount of fat in the abdominal region and also to generally improve the person's physical conditioning. The device particularly permits the user to perform several times the number of repetitions of the exercise than would otherwise be possible.

Figure 3:
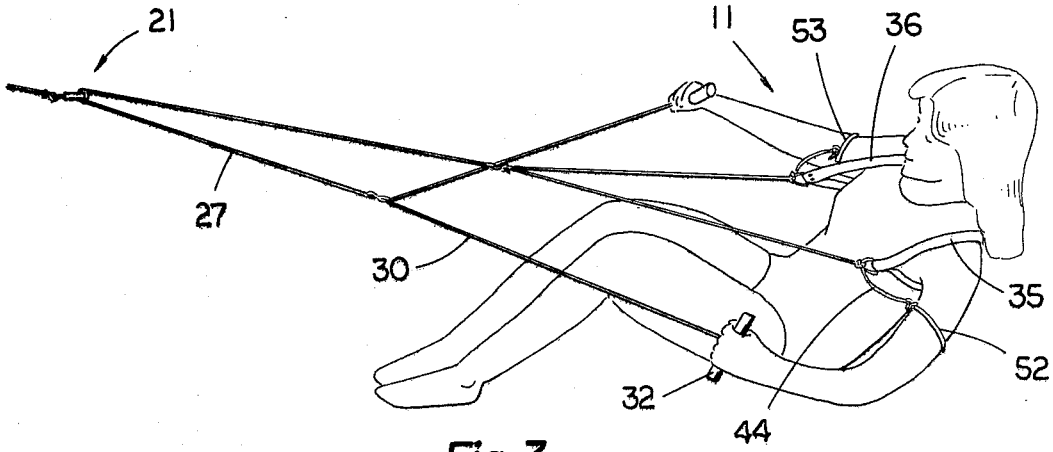
FIG. 3 is an illustrative view of the exercise device of the present invention, showing one of the initial exercise positions used in conjunction with the device.

To use the device, the person must first assume the proper starting position. In FIG. 3 there is shown one of the preferred starting positions for the sit-up exercise to be performed in conjunction with the exercise device of the present invention. In this position, the legs are preferably bent at the knees and the feet are flat on the floor. The handle grips 32 are grapsed by the person, who then leans back until the line 27 is drawn taut. In this position, (FIG. 3) the elbows should be completely straight. Several variations on the initial position for the sit-up exercise may be made, with differing effectiveness of the exercise resulting. Thus, the exercise may be performed with the legs straight and resting on the heels of the feet. Also, the inclination of the person's back to the floor in the initial position may be varied, and the person may even be lying flat on the floor in the initial position.

Figure 4:
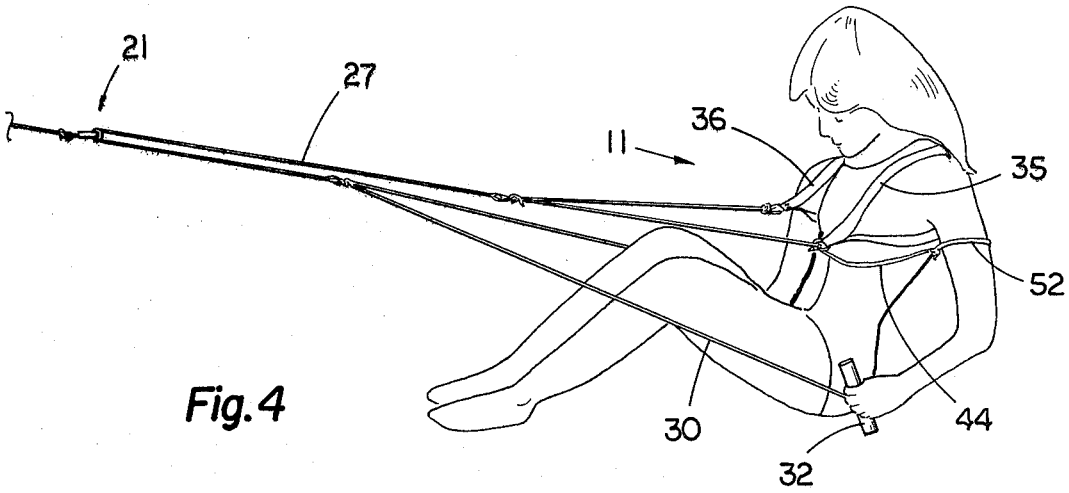
FIG. 4 is an illustrative view of the exercise device of the present invention, showing the final exercise position for a bent-knee sit-up as performed with the device.

The exercise consists of the person leaning forward to bring the chest close to the knees, as is particularly shown in FIG. 4. Force exerted by the person to move the handle grips 32 away from pulley 21 will be transmitted through lines 30, 27 and 44 to urge the harness 11 toward pulley 21. The user of the device is therefore able to reduce the amount of physical effort required to perform any single sit-up, and as a result is able to perform a greater number of repetitions of the exercise. With the exercise device 10 of the present invention, several hundred sit-ups of the bent-knee type may be performed in a 15-minute period.

The function of the arm loops 52 and 53 is apparent from FIG. 4. As the user of the device moves to the position shown in FIG. 4, the elbows necessarily move outwardly and downwardly. The arm loops thus cause the ends of the straps 35 and 36 to move outwardly to some extent, and prevent the straps from moving against and irritating the user's neck.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. An exercise device which comprises:

a pulley;

attachment means for attaching said pulley to a fixed support;

a first, flexible line recieved about said pulley, said first, flexible line having a first end and a second end;

handle means secured to the first end of said first flexible line for providing a location to be grasped by a person, said handle means comprising a second flexible line having handle grips secured at each end, the first end of said first flexible line being attached to the second flexible line at about the middle thereof; and a harness adapted to be received about the shoulders of a person, said harness comprising a pair of straps, each strap having a first end and a second end, the first ends of said straps being secured together and the second ends of said straps being secured together, said straps being crossed intermediate the first ends and the second ends and forming shoulder openings, said harness further comprising a third flexible line having a first end and a second end, the first end of the third flexible line being connected to the first ends of said straps, the second end of the third flexible line being connected to the second ends of said straps, the second end of said first flexible line being connected to the third flexible line at about the middle thereof, whereby force applied to move said handle means away from said pulley is transmitted through said first flexible line to move said harness toward said pulley.

2. The device of claim 1 in which said harness further includes first and second arm loop members, the first arm loop member being connected to said straps adjacent the first ends of said straps, the second arm loop member being connected to said straps adjacent the second ends of said straps, the arm loop members being adapted to extend about the arms of a person.

* * * * *